United States Patent [19]

Kompanek

[11] 4,257,482

[45] Mar. 24, 1981

[54] SONIC GRAVEL PACKING METHOD AND TOOL FOR DOWNHOLE OIL WELLS

[76] Inventor: Harry W. Kompanek, 153 Rametto Rd., Santa Barbara, Calif. 93108

[21] Appl. No.: 33,854

[22] Filed: Apr. 27, 1979

[51] Int. Cl.[3] ..... E21B 43/04

[52] U.S. Cl. ..... 166/249; 166/105; 166/177; 166/278

[58] Field of Search ..... 166/278, 51.67, 177.65 R, 166/105, 107, 249, 286; 310/322

[56] References Cited

U.S. PATENT DOCUMENTS

| | | | |
|---|---|---|---|
| 2,437,456 | 3/1948 | Bodine, Jr. | 166/177 X |
| 2,705,460 | 4/1955 | Burdick | 166/177 UX |
| 2,812,452 | 11/1957 | Harris | 310/322 |
| 2,974,273 | 3/1961 | Vogel et al. | 166/177 X |
| 3,113,621 | 12/1963 | Krueger et al. | 166/278 X |
| 3,378,075 | 4/1968 | Bodine | 166/177 X |
| 3,557,875 | 1/1971 | Solum et al. | 166/278 X |
| 3,578,081 | 5/1971 | Bodine | 166/177 X |
| 3,583,677 | 6/1971 | Phillips | 166/177 X |

*Primary Examiner*—Stephen J. Novosad
*Attorney, Agent, or Firm*—Ellsworth R. Roston; Charles H. Schwartz

[57] ABSTRACT

Gravel is packed around a casing in an oil well to prevent sand from entering into the casing, to loosen the sand around the gravel and facilitate the flow of oil into the casing. The gravel is vibrated around the periphery of the casing at a particular harmonic between approximately 1100 Hertz and 1700 Hertz. The transducer may be slotted to facilitate the production of a considerable amount of energy at the particular harmonic without breaking the transducer. When slotted, the transducer may be disposed within a slotted ring to facilitate the production of a considerable amount of energy at the particular harmonic without breaking the transducer. The transducer and the slotted ring may be disposed within a sleeve which may be filled with oil. At least one of the anti-nodes of the transducer may be clamped to produce vibrations at the particular harmonic without producing vibrations at the fundamental frequency. The transducer may be tuned so that the frequency of the particular harmonic such as the fifth harmonic is at the lowest possible value. This may be accomplished by partially slotting the metal ring at a position displaced from the slot in the ring or by adding mass to the ends of the transducer. The module described above may be depended from the bottom of the casing in a plurality of similar modules whose slots may be annularly staggered to facilitate the packing of the gravel without voids.

20 Claims, 3 Drawing Figures

SONIC GRAVEL PACKING METHOD AND TOOL FOR DOWNHOLE OIL WELLS

Figure 1:
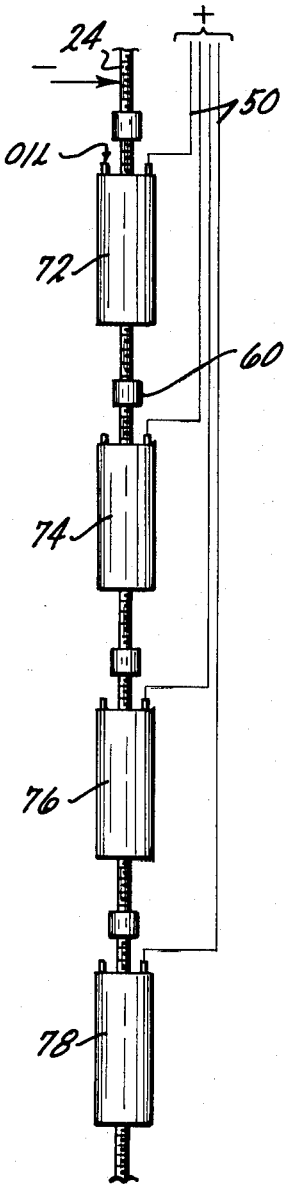

This invention relates to a method of packing gravel around a casing in an oil well without any voids to prevent sand from entering into the pump. The invention also relates to a method of facilitating the flow of oil into the casing. The invention further relates to apparatus for providing the methods specified above.

When a pump in an oil well is operated, there is a tendency for sand to accumulate in the casing and clog the pump. This is particularly true when the sand around the gravel pack is loose. Various attempts have been made to solve this problem. However, these attempts have not been very successful even though considerable research has been made to solve the problem and the problem has been longstanding.

In one of the primary methods used to solve the clogging of pumps by loose sand, viscous fluids have been introduced to the loose sand around the casing to settle the sand. The use of viscous fluid has had certain disadvantages. One disadvantage has been that the fluid has not produced uniform results around the periphery of the casing because the fluid has not settled evenly around the periphery of the casing. This has created voids and has caused sand to enter the perforation in the casing through the voids. Another disadvantage has been that the effect of the fluid has been only temporary because the fluid has tended to settle even though viscous. A further disadvantage has been that the fluid has been somewhat expensive.

This invention provides a method which overcomes the above difficulties. The invention provides a method of permanently packing gravel around a casing so that sand cannot enter into the casing through the perforations in the casing. The invention accomplishes this by packing the gravel tightly and uniformly around the casing so that no voids are produced. The overall density of the gravel packed by applicant's invention is greatly enhanced relative to the density of packing of the gravel in the prior art. The invention is also operative to facilitate the flow of oil into the casing through the loose sand around the gravel and through the gravel.

Applicant's method involves the vibration of the gravel with relatively high energy at a frequency in the range of approximately 1100 Hertz to 1700 Hertz. Such vibrations cause the gravel to become firmly packed around the casing. The vibrations are also transmitted to the loose sand around the gravel to loosen the sand and provide paths for the flow into the casing of oil in the loose sand.

Applicant's method may be accomplished by different apparatus. A preferred apparatus includes a ceramic transducer annularly shaped and provided with an axial slot. A ring made from a suitable material such as aluminum is disposed around the outer periphery of the ceramic transducer to support the transducer. The ring is preferably slotted at a position corresponding to the slot in the transducer.

The ring is advantageous in helping to prevent the transducer from breaking when the transducer is subjected to relatively high energy levels. The ring is further advantageous in reducing the frequency of vibration of the transducer so that frequencies in the range of 1100 Hertz to 1700 Hertz are produced at a relatively low harmonic such as the fifth harmonic. This tends to enhance the amount of energy produced by the transducer in the desired frequency range.

In one embodiment, the ring is clamped at antinodal positions to facilitate the production of vibrations at the particular frequency such as the fifth vibration. Means may be provided in the transducer to facilitate the production of the particular harmonic at as low a frequency as possible. Such means may constitute a partial slotting of the ring at a position removed from the slot in the ring or it may constitute the addition of masses to the slotted ends of the transducer.

The combination of the ring and the transducer are depended from the pump. This combination may be disposed in a sleeve which may be filled with oil. If desired, a plurality of modules—each including a sleeve, a ring and a transducer—may be depended from the pump and from one another in a serial relationship. The slots in the ring and the transducer of each module may be annularly staggered relative to the slots in the rings and the transducers in other modules to provide for the production of vibrations with omni-directional properties by the array of modules.

Figure 2:
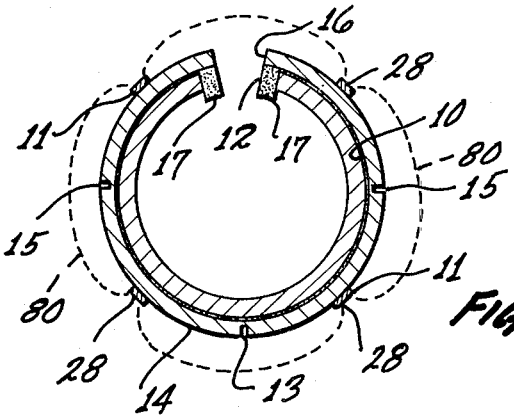
Figure 3:
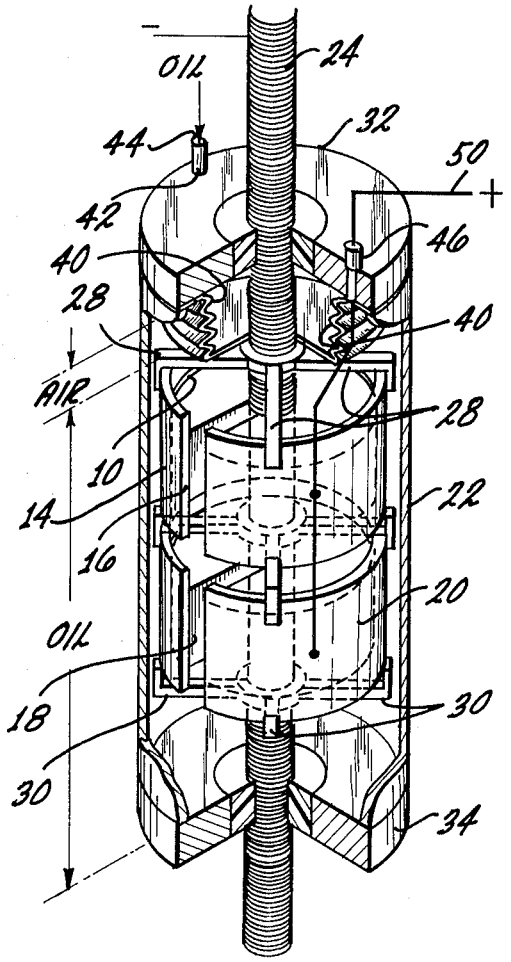

In the drawings:

FIG. 1 is a schematic view of a modular assembly constituting one embodiment of the invention;

FIG. 2 is a schematic view of the modular assembly shown in FIG. 1 and illustrates the clamping positions of the assembly for producing vibrations at a particular harmonic such as the fifth harmonic and further illustrates modifications in the assembly for obtaining the production of such harmonics at the lowest possible frequency; and FIG. 3 is an enlarged perspective, detailed view, partially broken away, of one of the modules shown in FIG. 1.

In the embodiment of the invention shown in the drawings, a ceramic transducer generally indicated at 10 may be made from a suitable material such as lead zirconate and lead titanate to have piezoelectric properties. The ceramic transducer 10 is preferably provided with an annular configuration and is preferably slotted axially as at 12. The axial slotting of the transducer facilitates the production of vibratory energy at a relatively high level by the transducer without breaking the transducer.

The transducer 10 is disposed within a ring 14 which may be made from a suitable material such as aluminum. The transducer 10 is preferably bonded to the inner surface of the ring 14. The ring 14 is preferably slotted as at 16, the slot 16 being aligned with the slot 12 in the transducer.

The ring 14 may be clamped at spaced positions indicated at 11 to facilitate the production of vibrations at a particular harmonic such as the fifth harmonic without the production of vibrations at the fundamental frequency. The clamping of the ring at the spaced positions 11 is different from the clamping in the prior art since the clamping in the prior art has occurred at a position 13 diametrically opposite the slots 12 and 16.

Means may be provided to facilitate the production of the particular harmonic at as low a frequency as possible. Such means may include a partial slotting of the ring 14 at positions 15 midway between the clamping positions 11. Such means may further include the addition of masses 17 to the ends of the ceramic transducer 10 at positions adjacent the slot 12.

A transducer 18 and a ring 20 respectively corresponding to the transducer 10 and the ring 14 may also be provided. The assembly of the transducer 10 and the ring 12 and the assembly of the transducer 18 and the ring 20 are disposed in spaced, co-axial relationship in a sleeve 22. The rings 14 and 20 are preferably spaced from the inner wall of the sleeve 22, which is preferably made from a suitable metal such as aluminum or stainless steel or other strong electrically conductive material. By way of illustration, the sleeve may have an axial length of approximately twelve inches (12") and a diameter of approximately three and one half inches (3.5"). The sleeve 22 is preferably provided with a thin wall.

A support rod 24 extends axially through the sleeve 20 and the transducers 10 and 18. The rod 24 may be dependent from the bottom of the pump (not shown). Mounting brackets 28 and 30 respectively extend from the support rod 24 to the rings 14 and 20 to support the assembly of the transducer 10 and the ring 14 and the assembly of the transducer 18 and the ring 20. End plates 32 and 34 are disposed at opposite ends of the sleeve 22 and are coupled to the support rod 24 to provide a support by the rod of the sleeve 22. Seals are provided between the support rod and the end plates 32 and 34 to prevent any leakage of oil, which is preferably disposed within the sleeve 22.

A bellows 40 is preferably disposed adjacent the end cap 32. The bellows expands or contracts with changes in temperature to provide compensations within the sleeve 22 for changes in the space occupied by the oil in accordance with such changes in temperature and pressure. A passage 42 extends through the end cap 32 and communicates with the hollow interior of the sleeve to provide for the introduction of oil into the sleeve. The passage 42 may be sealed by a plug 44.

A passage 46 also extends through the end cap 34. A plug may be provided to seal the passage 46. The passage 46 provides for the introduction of an electrode 50 to the transducers 10 and 18 to energize the transducers with a suitable potential such as a positive potential. The negative potential may be provided by the electrical grounding of the sleeve 22 or the introduction of a negative potential to the sleeve.

In the actual construction, a plurality of modules 72, 74, 76 and 78 may be provided, each having a construction as described above. Each of the modules 72, 74, 76 and 78 may be coupled to the adjacent module by a suitable coupling such as a nut 60 which is threadably attached to the rod 24. The spacing between adjacent modules may be adjusted by modifying the position of the nut 60 on the rod 24. Each of the modules in the plurality is preferably staggered annularly relative to adjacent modules so that the slots in the transducers in each module face in a different direction than the slots in the transducers in other modules.

The number of modules and the spacing between the modules are dependent upon the particular geometry of the well and the particular size of the gravel and height of the pack around the well. The number of modules can vary between one (1) and as many as forty (40). The spacing between the modules can vary from a few inches to a few feet. All of such variables can be determined at the well site from logging data.

The plurality of transducer modules are energized by introducing voltages to the transducers. This causes the transducers to vibrate between the antinodal or clamping positions 11 on the ring 14. Such vibrations are indicated schematically at 80 in FIG. 2. The transducers vibrate at a frequency dependent upon the parameters of the transducers. The vibrations occur at only harmonic frequencies because of the clamping of the ring 14 at one or more of the antinodal positions 11.

The frequency of the lowest harmonic such as the fifth harmonic can be adjusted by adjusting the masses 17 at the ends of the ceramic transducer adjacent the slot 12. The frequency can also be adjusted by partially slotting the ring 14 at positions midway between adjacent antinodal positions 11. Such additions of mass to the ends of the transducer 11 and partial slotting of the ring 14 tend to reduce the frequency of vibrations.

The transducers are constructed so that a relatively low harmonic, such as the fifth harmonic, has a frequency in a particular range such as a range of approximately 1100 Hertz to 1700 Hertz and so that the amount of energy available in the particular range of frequencies is quite large. For example, the modular unit shown in FIG. 1 has been driven with an amplifier providing approximately 2000 watt power. The actual power obtained at a frequency of approximately 1700 Hertz has been approximately 600 watts.

When the modular assembly shown in the drawings and described above is vibrated, it provides a uniform "near field" of considerable energy at the particular harmonic such as the fifth harmonic. This uniform "near field" results in part because of the clamping of the ring 11 at one or more of the antinodal positions such that the vibrations are repeated at four progressive positions around the annular periphery of the ring 14 when vibrations at the fifth harmonic are to be produced. This repetition around the annular periphery of the ring 14 tends to produce a substantially uniform field around the ring 14 and facilitates the packing of the gravel tightly and uniformly around the casing. In this way, no voids are created.

The tight and uniform packing of the gravel around the casing can be maintained by producing the vibrations continuously or at least periodically. The production of a tight and uniform packing of the gravel without voids is facilicated by the use of a plurality of modules and the disposition of the modules in annularly staggered relationship to one another. Such an arrangement causes the antinodal positions 11 on the different modules to be staggered, thereby facilitating the production of a uniform "near field" by the modular assembly.

In addition to packing the gravel tightly and unformly in the "near field", the vibrations stimulate a "boundary layer" which is displaced from the gravel and is located a particular distance such as a few inches from the well. This stimulation of the "boundary layer" causes the flow of water and oil into the pump to increase even with the tightened packing of the gravel around the casing.

The particular modules used to produce the vibrations in the desired frequency range also have certain important advantages. For example, by disposing the transducers in the rings and by providing slots in the transducers and the rings, considerable energy can be provided by the transducers at relatively low frequencies without breaking the transducers.

As will be appreciated, other types of transducer modules may be used instead of the modules described above to provide the method described above. For example, a module disclosed and claimed by me in copending application Ser. No. 934,360 filed by me on Aug. 17, 1978, for an "Electromechanical Transducer" may be used satisfactorily to produce the desired method and obtain the desired results. This is particularly true when the modules are clamped at the antinodal positions in the manner discussed above.

Although this application has been disclosed and illustrated with reference to particular applications, the principles involved are susceptible of numerous other applications which will be apparent to persons skilled in the art. The invention is, therefore, to be limited only as indicated by the scope of the appended claims.

I claim:

1. In combination for preventing sand from flowing into a pump for an oil well, a support rod constructed to be supported from the pump, means including a hollow sleeve supported by the support rod, means including a transducer supported by the support rod within the sleeve and having properties of vibrating at a frequency of approximately 1100 Hertz to 1700 Hertz when energized to pack gravel tightly around the pump, and means for energizing the transducer to produce vibrations between approximately 1100 Hertz to 1700 Hertz.

2. The combination set forth in claim 1 wherein the sleeve is filled by oil and wherein the transducer is supported within a ring having properties of controlling the vibrations of the transducer at a frequency of approximately 1100 Hertz to 1700 Hertz and preventing the transducer from breaking when the transducer is energized at a high level of power.

3. The combination as set forth in claim 1 wherein a plurality of modules are dependent from the pump, each having a support rod, sleeve means, transducer means and energizing means as recited in claim 1 and wherein the modules in the plurality are disposed in a staggered arrangement relative to one another.

4. The combination set forth in claim 1 wherein each of the modules in the plurality depends from the rod in the next-highest module and is annularly staggered relative to the other modules in the plurality.

5. In combination for preventing sand from flowing into a pump for an oil well, transducer means constructed to vibrate at a frequency having a lower harmonic in the range of approximately 1100 Hertz to 1700 Hertz to produce sound waves having substantially omni-directional characteristics in planes substantially perpendicular to the pump and having considerable energy as a result of such vibrations, means for energizing the transducer means to produce vibrations of the transducer, and means for supporting the transducer means from the bottom of the pump for the production of the energy with omni-directional characteristics in planes substantially perpendicular to the oil well, the transducer means including at least one slotted transducer supported within a slotted ring to provide for a generation by the transducer of considerable amounts of energy in the range of approximately 1100 Hertz to 1700 Hertz without breaking the transducer.

6. The combination set forth in claim 5 wherein the transducer, the energizing means and the support means constitute a module and wherein a plurality of such modules are disposed in a vertical array with the slots in the transducer and in the ring in each module staggered relative to the slots in the transducer and in the ring in other modules in the plurality.

7. A method of packing gravel around a well bore to prevent sand from entering into the well bore, including the following steps:

clamping a transducer at at least one of a plurality of spaced antinodal positions around the periphery of the transducer to obtain vibrations of the transducer at a particular harmonic without obtaining vibrations of the transducer at a fundamental frequency, disposing the transducer at the bottom of a well, and energizing the transducer to vibrate the transducer at the particular harmonic.

8. A method as set forth in claim 7 wherein the transducer is slotted and masses are disposed on the transducer at the ends of the slots to reduce the frequency of vibrations of the transducer at the particular frequency.

9. A method as set forth in claim 7 wherein a ring is disposed around the transducer and the ring is slotted at a position between an adjacent pair of the antinodal positions and is partially slotted at positions substantially midway between other adjacent pairs of the antinodal positions.

10. A method as set forth in claim 7 wherein, the transducer is constructed to provide the vibrations at the particular harmonic at as low a frequency as possible.

11. A method as set forth in claim 7 wherein the particular harmonic is the fifth harmonic and has a frequency between approximately 1100 Hertz and 1700 Hertz.

12. A method as set forth in claim 7 wherein a plurality of transducers are disposed in a modular assembly and the antinodal positions in each of the transducers in the plurality are staggered relative to the antinodal positions in the other transducers in the plurality.

13. In combination for preventing sand from flowing into a pump for an oil well, an annular transducer, means for clamping the transducer at at least one of a plurality of antinodal positions spaced around the annular periphery of the transducer to obtain the production of vibrations at a particular harmonic without obtaining the production of vibrations at a fundamental frequency, means for supporting the transducer in the well at a position near the pump, and means for energizing the transducer to obtain the production of vibrations at the particular harmonic.

14. The combination set forth in claim 13 including, means associated with the transducer for reducing the frequency of vibrations of the transducer at the particular harmonic to as low a value as possible.

15. The combination set forth in claim 14 wherein the frequency-reducing means include masses on the transducer at positions adjacent the slot in the transducer.

16. The combination set forth in claim 13 wherein the transducer is slotted and a ring is disposed around the transducer and the ring is slotted at the same position as the slot in the transducer and the ring is clamped at the antinodal positions.

17. The combination set forth in claim 15 wherein the slots in the transducer and the ring are provided substantially midway between an adjacent pair of antinodal positions.

18. The combination set forth in claim 17 wherein the ring is partially slotted at positions substantially midway between other adjacent pairs of the antinodal positions to reduce the frequency of the particular harmonic to as low a value as possible.

19. The combination set forth in claim 13 wherein the particular harmonic provides frequencies in the range of 110 Hertz to 1700 Hertz.

20. The combination set forth in claim 13 wherein the transducer is disposed in a modular assembly including a plurality of similar transducers and wherein the antinodal positions in the different transducers in the plurality are staggered relative to one another.

* * * * *